US010295945B2

(12) United States Patent
Matsumoto

(10) Patent No.: US 10,295,945 B2
(45) **Date of Patent: *May 21, 2019**

(54) IMAGE FORMING APPARATUS AND CONTROL METHOD

(71) Applicants: KABUSHIKI KAISHA TOSHIBA, Tokyo (JP); TOSHIBA TEC KABUSHIKI KAISHA, Tokyo (JP)

(72) Inventor: Hirotaka Matsumoto, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/055,648

(22) Filed: Aug. 6, 2018

(65) Prior Publication Data

US 2018/0348686 A1 Dec. 6, 2018

Related U.S. Application Data

(63) Continuation of application No. 15/402,567, filed on Jan. 10, 2017, now Pat. No. 10,042,302.

(51) Int. Cl.
*G03G 15/00* (2006.01)
*G03G 15/20* (2006.01)

(52) U.S. Cl.
CPC ..... *G03G 15/5062* (2013.01); *G03G 15/5029* (2013.01); *G03G 15/2053* (2013.01); *G03G 2215/2045* (2013.01)

(58) Field of Classification Search
CPC ..... G03G 15/2039; G03G 15/2042; G03G 15/5029
See application file for complete search history.

(56) References Cited

U.S. PATENT DOCUMENTS

2013/0209120 A1* 8/2013 Namekata ..... G03G 15/2042 399/67
2015/0049390 A1* 2/2015 Lanman ..... G02B 27/0075 359/622

FOREIGN PATENT DOCUMENTS

JP 2007-193165 A 8/2007

OTHER PUBLICATIONS

Hirotaka Matsumoto, U.S. Appl. No. 14/717,853, filed May 20, 2015.
Okegawa et al. (JP 2007-193165 A), Aug. 2007, JPO Computer Translation.

* cited by examiner

*Primary Examiner* — Erika J Villaluna
(74) *Attorney, Agent, or Firm* — Kim & Stewart LLP

(57) ABSTRACT

An image forming apparatus according to an embodiment includes a fixing section that fixes a toner image formed on a sheet. A controller controls a preliminary rotation of the fixing section after execution of a first image forming job and before execution of a second image forming job. Conditions for the preliminary rotation include types of sheets used in the first image forming job and the second image forming job, respectively, and a number of sheets used in executing the first image forming job.

8 Claims, 9 Drawing Sheets

| MEDIA CONDITION | | PRELIMINARY RUN CONDITION | |
|---|---|---|---|
| FIRST JOB | SECOND JOB | COUNTER THRESHOLD VALUE | PRELIMINARY RUN TIME |
| THIN PAPER | THIN PAPER | REFERENCE NUMBER | LONG TIME |
| THIN PAPER | REGULAR PAPER | REFERENCE NUMBER | MEDIUM TIME |
| THIN PAPER | THICK PAPER | REFERENCE NUMBER | SHORT TIME |
| REGULAR PAPER | THIN PAPER | REFERENCE NUMBER | LONG TIME |
| REGULAR PAPER | REGULAR PAPER | REFERENCE NUMBER | MEDIUM TIME |
| REGULAR PAPER | THICK PAPER | REFERENCE NUMBER | SHORT TIME |
| THICK PAPER | THIN PAPER | SMALLER THAN REFERENCE NUMBER | LONG TIME |
| THICK PAPER | REGULAR PAPER | SMALLER THAN REFERENCE NUMBER | MEDIUM TIME |
| THICK PAPER | THICK PAPER | SMALLER THAN REFERENCE NUMBER | SHORT TIME |

| FIRST IMAGE FORMING JOB \ SECOND IMAGE FORMING JOB | | | PAPER WIDTH SIZE CONDITION OF NEXT PRINT JOB | | | | | | | | |
|---|---|---|---|---|---|---|---|---|---|---|---|
| | | | THIN PAPER (EMBODIMENT: BASIS WEIGHT 50~59g/m²) | | | REGULAR PAPER (EMBODIMENT: BASIS WEIGHT 60~99g/m²) | | | THICK PAPER (EMBODIMENT: BASIS WEIGHT 100~210g/m²) | | |
| PAPER WIDTH SIZE CONDITION OF PREVIOUS PRINT JOB | | | LARGE | MEDIUM | SMALL | LARGE | MEDIUM | SMALL | LARGE | MEDIUM | SMALL |
| MEDIA PAPER | PAPER WIDTH SIZE(Xmm) | | | | | | | | | | |
| THIN PAPER | LARGE | PRELIMINARY RUN CONTROL | NOT EXECUTE | NOT EXECUTE | NOT EXECUTE | NOT EXECUTE | NOT EXECUTE | NOT EXECUTE | NOT EXECUTE | NOT EXECUTE | NOT EXECUTE |
| | | PRINT COUNTER | CONTINUE | RESET | RESET | CONTINUE | RESET | RESET | CONTINUE | RESET | RESET |
| | MEDIUM | PRELIMINARY RUN CONTROL | EXECUTE | NOT EXECUTE | NOT EXECUTE | EXECUTE | NOT EXECUTE | NOT EXECUTE | EXECUTE | NOT EXECUTE | NOT EXECUTE |
| | | PRINT COUNTER | RESET | CONTINUE | RESET | RESET | CONTINUE | RESET | RESET | CONTINUE | RESET |
| | SMALL | PRELIMINARY RUN CONTROL | EXECUTE | EXECUTE | NOT EXECUTE | EXECUTE | EXECUTE | NOT EXECUTE | EXECUTE | EXECUTE | NOT EXECUTE |
| | | PRINT COUNTER | RESET | RESET | CONTINUE | RESET | RESET | CONTINUE | RESET | RESET | CONTINUE |
| REGULAR PAPER | LARGE | PRELIMINARY RUN CONTROL | NOT EXECUTE | NOT EXECUTE | NOT EXECUTE | NOT EXECUTE | NOT EXECUTE | NOT EXECUTE | NOT EXECUTE | NOT EXECUTE | NOT EXECUTE |
| | | PRINT COUNTER | CONTINUE | RESET | RESET | CONTINUE | RESET | RESET | CONTINUE | RESET | RESET |
| | MEDIUM | PRELIMINARY RUN CONTROL | EXECUTE | NOT EXECUTE | NOT EXECUTE | EXECUTE | NOT EXECUTE | NOT EXECUTE | EXECUTE | NOT EXECUTE | NOT EXECUTE |
| | | PRINT COUNTER | RESET | CONTINUE | RESET | RESET | CONTINUE | RESET | RESET | CONTINUE | RESET |
| | SMALL | PRELIMINARY RUN CONTROL | EXECUTE | EXECUTE | NOT EXECUTE | EXECUTE | EXECUTE | NOT EXECUTE | EXECUTE | EXECUTE | NOT EXECUTE |
| | | PRINT COUNTER | RESET | RESET | CONTINUE | RESET | RESET | CONTINUE | RESET | RESET | CONTINUE |
| THICK PAPER | LARGE | PRELIMINARY RUN CONTROL | NOT EXECUTE | NOT EXECUTE | NOT EXECUTE | NOT EXECUTE | NOT EXECUTE | NOT EXECUTE | NOT EXECUTE | NOT EXECUTE | NOT EXECUTE |
| | | PRINT COUNTER | CONTINUE | RESET | RESET | CONTINUE | RESET | RESET | CONTINUE | RESET | RESET |
| | MEDIUM | PRELIMINARY RUN CONTROL | EXECUTE | NOT EXECUTE | NOT EXECUTE | EXECUTE | NOT EXECUTE | NOT EXECUTE | EXECUTE | NOT EXECUTE | NOT EXECUTE |
| | | PRINT COUNTER | RESET | CONTINUE | RESET | RESET | CONTINUE | RESET | RESET | CONTINUE | RESET |
| | SMALL | PRELIMINARY RUN CONTROL | EXECUTE | EXECUTE | NOT EXECUTE | EXECUTE | EXECUTE | NOT EXECUTE | EXECUTE | EXECUTE | NOT EXECUTE |
| | | PRINT COUNTER | RESET | RESET | CONTINUE | RESET | RESET | CONTINUE | RESET | RESET | CONTINUE |

FIG.6

FIG.7

| MEDIA CONDITION | | PRELIMINARY RUN CONDITION | |
|---|---|---|---|
| FIRST JOB | SECOND JOB | COUNTER THRESHOLD VALUE | PRELIMINARY RUN TIME |
| THIN PAPER | THIN PAPER | REFERENCE NUMBER | LONG TIME |
| THIN PAPER | REGULAR PAPER | REFERENCE NUMBER | MEDIUM TIME |
| THIN PAPER | THICK PAPER | REFERENCE NUMBER | SHORT TIME |
| REGULAR PAPER | THIN PAPER | REFERENCE NUMBER | LONG TIME |
| REGULAR PAPER | REGULAR PAPER | REFERENCE NUMBER | MEDIUM TIME |
| REGULAR PAPER | THICK PAPER | REFERENCE NUMBER | SHORT TIME |
| THICK PAPER | THIN PAPER | SMALLER THAN REFERENCE NUMBER | LONG TIME |
| THICK PAPER | REGULAR PAPER | SMALLER THAN REFERENCE NUMBER | MEDIUM TIME |
| THICK PAPER | THICK PAPER | SMALLER THAN REFERENCE NUMBER | SHORT TIME |

| MEDIA CONDITION | | CONDITION | | |
|---|---|---|---|---|
| FIRST JOB | SECOND JOB | LARGE→SMALL | LARGE→MEDIUM | MEDIUM→SMALL |
| THIN PAPER | THIN PAPER | 25 PIECES OR MORE/40 SECONDS | 25 PIECES OR MORE/30 SECONDS | 100 PIECES OR MORE/30 SECONDS |
| THIN PAPER | REGULAR PAPER | 25 PIECES OR MORE/30 SECONDS | 25 PIECES OR MORE/20 SECONDS | 100 PIECES OR MORE/20 SECONDS |
| THIN PAPER | THICK PAPER | 25 PIECES OR MORE/15 SECONDS | 25 PIECES OR MORE/10 SECONDS | 100 PIECES OR MORE/15 SECONDS |
| REGULAR PAPER | THIN PAPER | 25 PIECES OR MORE/45 SECONDS | 25 PIECES OR MORE/30 SECONDS | 100 PIECES OR MORE/30 SECONDS |
| REGULAR PAPER | REGULAR PAPER | 25 PIECES OR MORE/30 SECONDS | 25 PIECES OR MORE/20 SECONDS | 100 PIECES OR MORE/20 SECONDS |
| REGULAR PAPER | THICK PAPER | 25 PIECES OR MORE/20 SECONDS | 25 PIECES OR MORE/15 SECONDS | 100 PIECES OR MORE/15 SECONDS |
| THICK PAPER | THIN PAPER | 15 PIECES OR MORE/45 SECONDS | 15 PIECES OR MORE/30 SECONDS | 50 PIECES OR MORE/30 SECONDS |
| THICK PAPER | REGULAR PAPER | 15 PIECES OR MORE/30 SECONDS | 15 PIECES OR MORE/20 SECONDS | 50 PIECES OR MORE/20 SECONDS |
| THICK PAPER | THICK PAPER | 15 PIECES OR MORE20 SECONDS | 15 PIECES OR MORE/15 SECONDS | 50 PIECES OR MORE/15 SECONDS |

FIG.8

| SECOND IMAGE FORMING JOB / FIRST IMAGE FORMING JOB | | | PAPER WIDTH SIZE CONDITION OF NEXT PRINT JOB | | | | | |
|---|---|---|---|---|---|---|---|---|
| | | | SPECIAL PAPER 1 (COATED PAPER) | | | REGULAR PAPER | | |
| PAPER WIDTH SIZE CONDITION OF PREVIOUS PRINT JOB | | | LARGE | MEDIUM | SMALL | LARGE | MEDIUM | SMALL |
| MEDIA PAPER | PAPER WIDTH SIZE(Xmm) | | | | | | | |
| SPECIAL PAPER 1 EMBODIMENT COATED PAPER | LARGE | PRELIMINARY RUN CONTROL | NOT EXECUTE | NOT EXECUTE | NOT EXECUTE | NOT EXECUTE | NOT EXECUTE | NOT EXECUTE |
| | | PRINT COUNTER | CONTINUE | RESET | RESET | CONTINUE | RESET | RESET |
| | MEDIUM | PRELIMINARY RUN CONTROL | EXECUTE | NOT EXECUTE | NOT EXECUTE | EXECUTE | NOT EXECUTE | NOT EXECUTE |
| | | PRINT COUNTER | RESET | CONTINUE | RESET | RESET | CONTINUE | RESET |
| | SMALL | PRELIMINARY RUN CONTROL | EXECUTE | EXECUTE | NOT EXECUTE | EXECUTE | EXECUTE | NOT EXECUTE |
| | | PRINT COUNTER | RESET | RESET | CONTINUE | RESET | RESET | CONTINUE |
| REGULAR PAPER EMBODIMENT REGULAR PAPER | LARGE | PRELIMINARY RUN CONTROL | NOT EXECUTE | NOT EXECUTE | NOT EXECUTE | NOT EXECUTE | NOT EXECUTE | NOT EXECUTE |
| | | PRINT COUNTER | CONTINUE | RESET | RESET | CONTINUE | RESET | RESET |
| | MEDIUM | PRELIMINARY RUN CONTROL | EXECUTE | NOT EXECUTE | NOT EXECUTE | EXECUTE | NOT EXECUTE | NOT EXECUTE |
| | | PRINT COUNTER | RESET | CONTINUE | RESET | RESET | CONTINUE | RESET |
| | SMALL | PRELIMINARY RUN CONTROL | EXECUTE | EXECUTE | NOT EXECUTE | EXECUTE | EXECUTE | NOT EXECUTE |
| | | PRINT COUNTER | RESET | RESET | CONTINUE | RESET | RESET | CONTINUE |

FIG.9

FIG.10

| MEDIA CONDITION | | PRELIMINARY RUN CONDITION | |
|---|---|---|---|
| FIRST JOB | SECOND JOB | COUNTER THRESHOLD VALUE | PRELIMINARY RUN TIME |
| COATED PAPER | COATED PAPER | REFERENCE NUMBER | LONG TIME |
| COATED PAPER | REGULAR PAPER | REFERENCE NUMBER | MEDIUM TIME |
| REGULAR PAPER | COATED PAPER | REFERENCE NUMBER | LONG TIME |
| REGULAR PAPER | REGULAR PAPER | REFERENCE NUMBER | MEDIUM TIME |

IMAGE FORMING APPARATUS AND CONTROL METHOD

CROSS-REFERENCE TO RELATED APPLICATION

This application is a continuation of U.S. patent application Ser. No. 15/402,567, filed on Jan. 10, 2017, the entire contents of each of which are incorporated herein by reference.

FIELD

Embodiments described herein relate generally to an image forming apparatus and a control method.

BACKGROUND

In an image forming apparatus, a plurality of print jobs may accumulate, and the print jobs are executed in order. In such an image forming apparatus, a problem of high temperature offset occurs according to categories of different print jobs in some cases. For example, in a case in which a print job on a large size paper is executed after a print job on a small size paper, the high temperature offset occurs. In such a case, the high temperature offset can be reduced by idling a fixing section before the execution of the print job on the large size paper. However, printing cannot be executed while the fixing section is idled, and there is a problem that efficiency of an operation of the image forming apparatus is reduced.

DESCRIPTION OF THE DRAWINGS

FIG. 6 is an example parameter table;

FIG. 7 is another example parameter table;

FIG. 8 is another example parameter table;

FIG. 9 is another example parameter table; and

FIG. 10 is another example parameter table.

DETAILED DESCRIPTION

An image forming apparatus according to an embodiment includes a fixing section that fixes a toner image formed on a sheet. A controller controls a preliminary rotation of the fixing section after execution of a first image forming job and before execution of a second image forming job. Conditions for the preliminary rotation include types of sheets used in the first image forming job and the second image forming job, respectively, and a number of sheets used in executing the first image forming job.

Hereinafter, an image forming apparatus of an embodiment is described with reference to the accompanying drawings.

Figure 1:
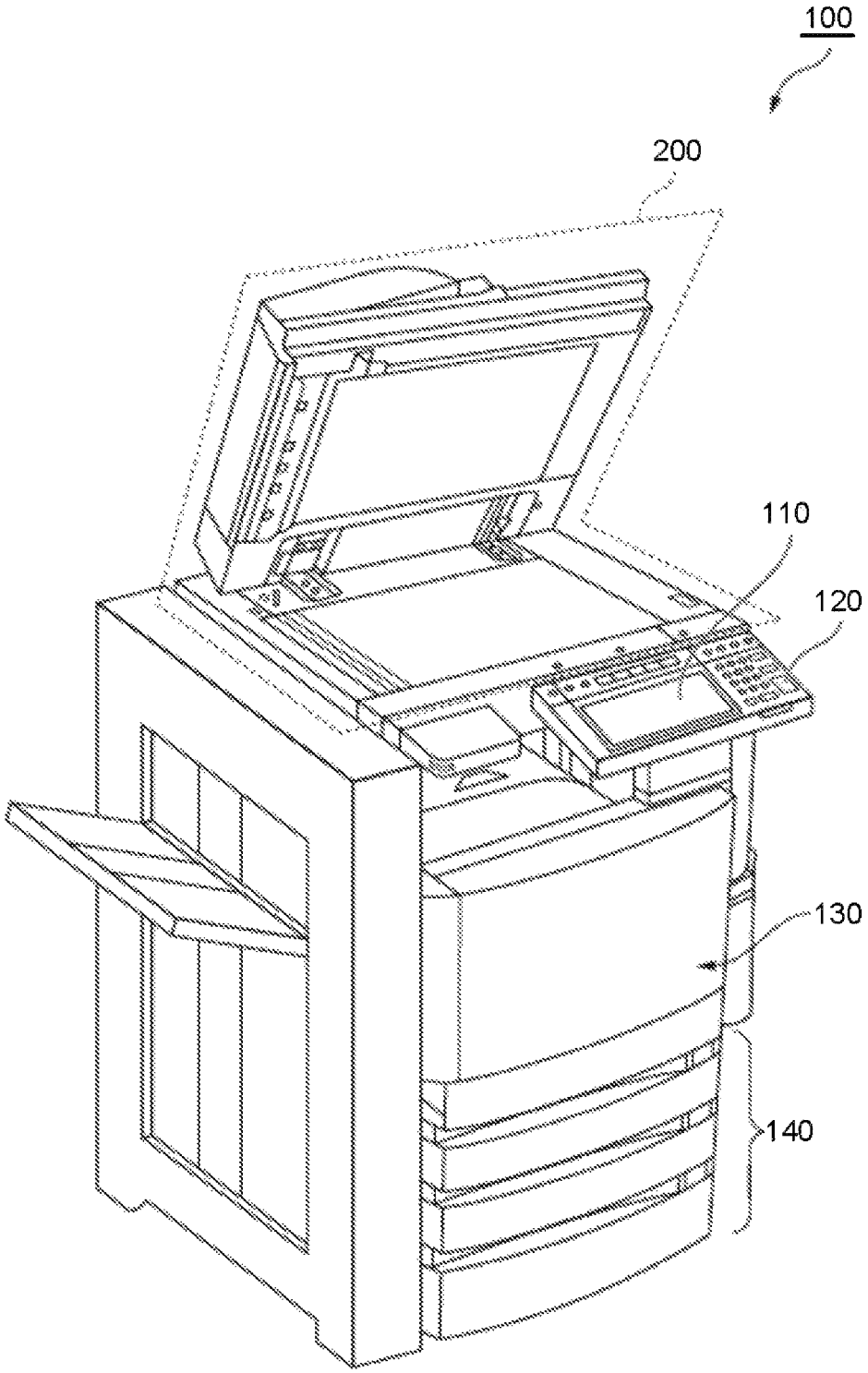
FIG. 1 is a perspective view illustrating an example image forming apparatus according to an embodiment.

FIG. 1 is a perspective view illustrating an example configuration of an image forming apparatus 100 according to the embodiment. The image forming apparatus 100 is, for example, a multifunctional printer. The image forming apparatus 100 includes a display 110, a control panel 120, a printer section 130, a sheet housing section 140 and an image reading section 200.

The image forming apparatus 100 forms an image on a sheet with a developing agent such toner. The sheet is, for example, a paper or a label paper. The sheet may be an object other than paper, as long as the image forming apparatus 100 can form an image on the surface thereof.

The printer section 130 forms an image on the sheet based on image information generated by the image reading section 200 or image information received via a communication interface. The printer section 130, for example, forms the image through the following processing. An image forming section of the printer section 130 forms an electrostatic latent image on a photoconductive drum based on the image information. The image forming section of the printer section 130 forms a visible image by applying the developing agent to the electrostatic latent image. Toner is an example of the developing agent. A transfer section of the printer section 130 transfers the visible image onto the sheet. A fixing section 50 of the printer section 130 fixes the visible image on the sheet through executing a fixing processing that heats and pressurizes the sheet. Furthermore, the sheet on which the image is formed may be a sheet housed in the sheet housing section 140. Alternatively, the sheet may be manually fed.

Figure 2:
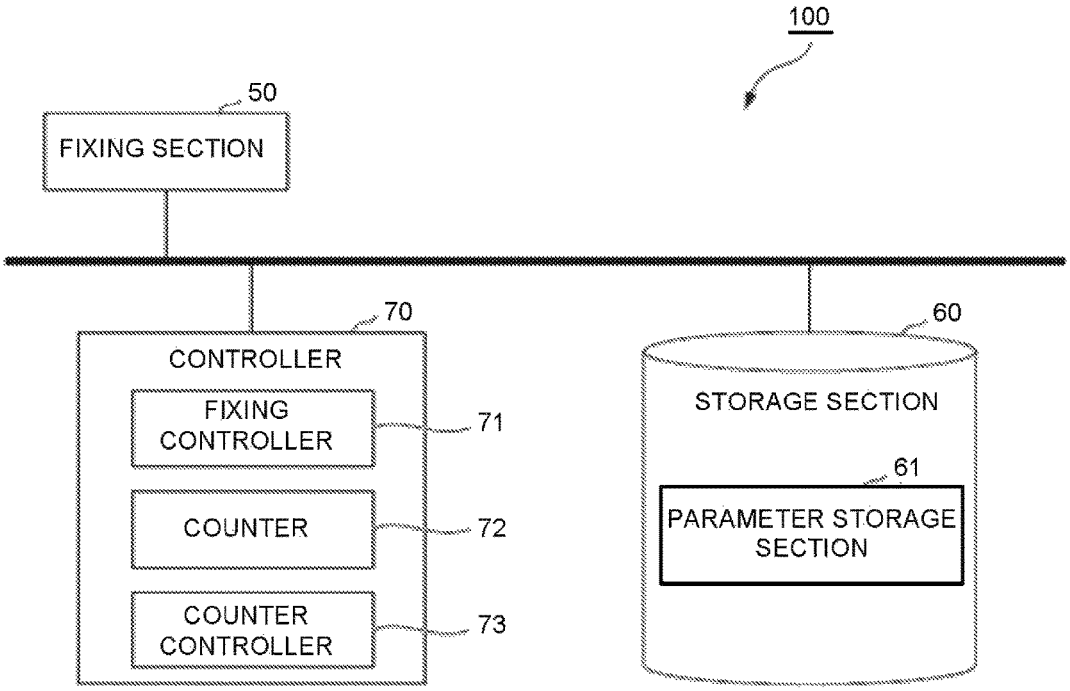
FIG. 2 is a functional block diagram illustrating a fixing processing of the image forming apparatus.

FIG. 2 is a functional block diagram illustrating the image forming apparatus 100. The image forming apparatus 100 includes the fixing section 50, a storage section 60 and a controller 70. The fixing section 50 fixes the visible image on the sheet by heating and pressing the sheet as stated above. The storage section 60 is a storage device such as a magnetic hard disk device, a semiconductor memory device or the like. The storage section 60 functions as a parameter storage section 61. The parameter storage section 61 stores parameters of a low temperature processing executed in the fixing section 50. The parameter storage section 61 may store, for example, a parameter table in which the parameters of the low temperature processing and conditions in which the parameters are used are stored in associated manner.

The controller 70 functions as a fixing controller 71, a counter 72 and a counter controller 73 through execution of a program by the CPU.

The fixing controller 71 controls an operation of the fixing section 50. The fixing controller 71, for example, controls the fixing section 50 according to execution of an image forming job (hereinafter, referred to as an "image forming job") input to the image forming apparatus 100. For example, the fixing controller 71 controls a temperature of a heater and a rotation speed of a roller of the fixing section 50 according to characteristics of the sheet used in the image forming job. Further, the fixing controller 71 controls the low temperature processing, which is a processing for equalizing or reducing the temperature of the fixing section 50. By executing the low temperature processing, the temperature of a portion of the fixing section 50 is reduced, and the temperature of the fixing section 50 in a width direction is thereby substantially equalized. The low temperature processing is executed after execution of a previous image forming job and before a subsequent image forming job. The previously executed image forming job is referred to as a first image forming job. The subsequent image forming job executed afterward is referred to as a second image forming job. The first image forming job and the second image forming job are sequentially executed. In a case in which the image forming apparatus 100 is equipped with a printer function, during initial processing of the first job and the second job and before the image formation is started (job build), the low temperature processing executes a preliminary run based on contents of the jobs. The preliminary run suppresses generation of offset in the second image forming job. In this way, the fixing controller 71 also functions as a preliminary run controller. The low temperature processing is, for example, a processing for rotating a plurality of rollers of the fixing section 50 in a state in which the energization to the heater is cut off, that is, the low temperature processing may be executed through preliminary run rotation. Normally, the preliminary run rotation is performed in a state in which the power to the heater is cut off (OFF state). However, the preliminary run may be executed in a state in which the energization power to the heater is being supplied (ON state). Furthermore, the second job may be based on a copy, so that the content of the second job is still unknown until a time point at which the copy relating to the second job is started after the execution of the first job is ended. However, in such a case, the execution or non-execution of the preliminary run and the content of the control of the preliminary run may be determined at a time point at which a copy start signal relating to the second job is input.

The fixing controller 71 may determine the parameters of the low temperature processing based on number of sheets on which the image formation is executed in the first image forming job and the size of the sheet (s). The fixing controller 71 may determine the parameters of the low temperature processing based on the number of sheets on which the image formation is executed in the first image forming job. The fixing controller 71 may determine the parameters of the low temperature processing based on the size of the sheet(s) on which the image formation is executed in the first image forming job. The fixing controller 71 may determine the parameters based on a parameter table stored in the parameter storage section 61, for example, as discussed further below.

The counter 72 counts the number of the sheets on which the fixing processing is executed by the fixing section 50. The counter 72 resets a value of the counter according to the control of the counter controller 73. If the value of the counter is reset, the number of the counter returns back to "0". Then, the counter 72 counts from "1".

The counter controller 73 controls whether to reset the value of the counter 72 between the first image forming job and the second image forming job. The counter controller 73, for example, controls the reset of the value of the counter 72 based on the contents of the first image forming job and the second image forming job.

Figure 3:
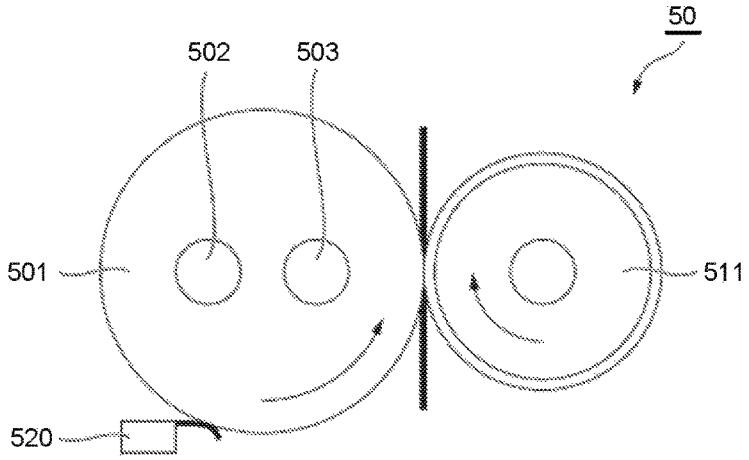
FIG. 3 is a diagram illustrating an example configuration of a fixing section.
Figure 4:
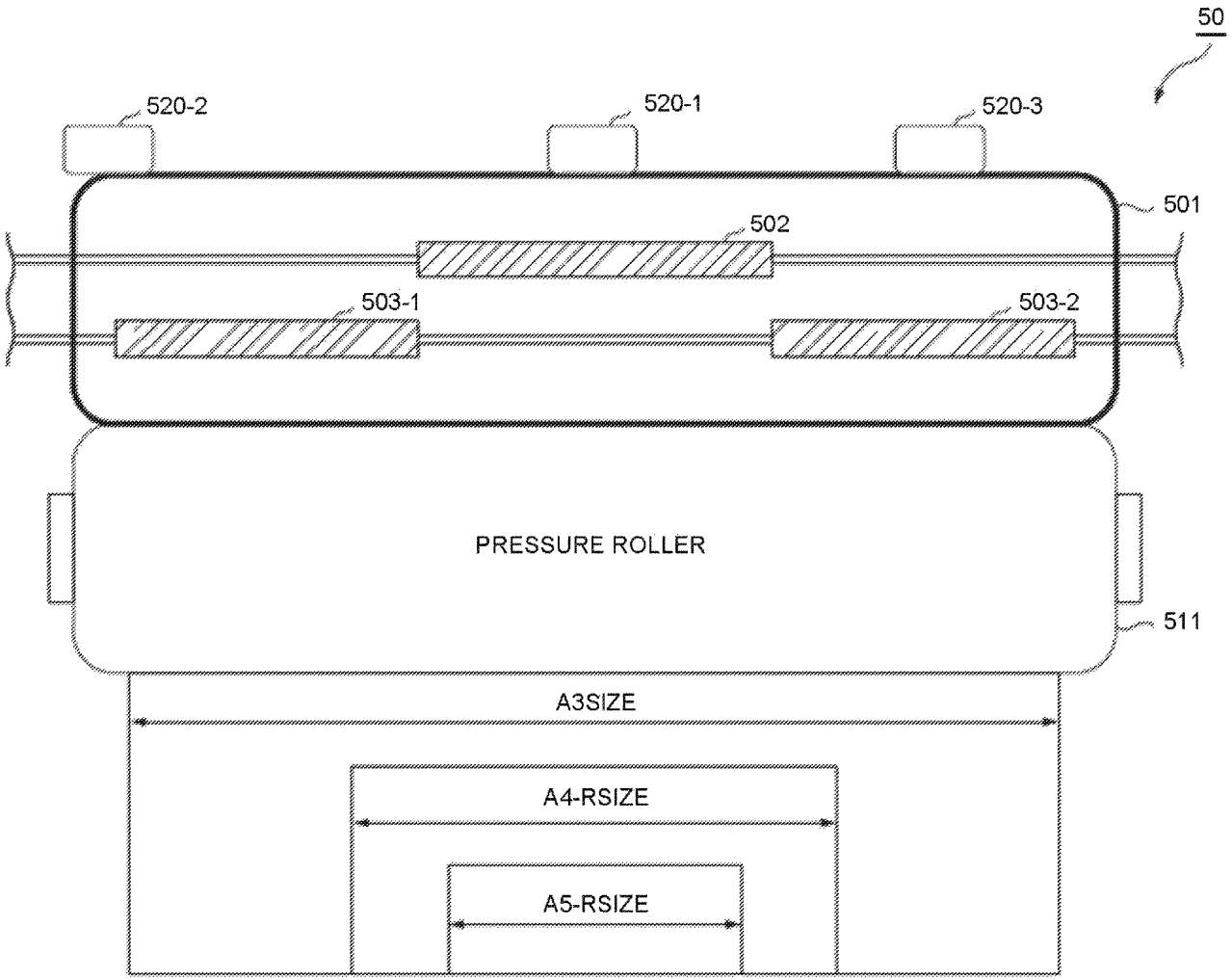
FIG. 4 is a diagram illustrating the fixing section.

FIG. 3 and FIG. 4 are diagrams illustrating an example configuration of the fixing section 50. The fixing section 50 includes, for example, a heat roller 501, a center heater 502, a side heater 503, a pressure roller 511 and a thermistor 520.

The heat roller 501 is a fixing member formed in a cylindrical shape. The center heater 502 and the side heater 503 are arranged inside the heat roller 501. The center heater 502 and the side heater 503 heat the heat roller 501 by generating heat. The center heater 502 heats an area approximately around the center of the heat roller 501 in a width direction. The side heater 503 heats an area approximately around both ends of the heat roller 501 in the width direction. For example, the side heater 503 includes a left side heater 503-1 and a right side heater 503-2. The left side heater 503-1 and the right side heater 503-2 respectively heat an area on a left end and an area on a right end of the heat roller 501.

The pressure roller 511 contacts and pressurizes the heat roller 501. Through contacting and pressurizing the pressure roller 511 with the heat roller 501, a fixing nip section is formed between the heat roller 501 and the pressure roller 511.

The thermistor 520 measures surface temperature of the heat roller 501. The thermistor 520, for example, includes a center thermistor 520-1, a left thermistor 520-2 and a right thermistor 520-3. The center thermistor 520-1 measures the surface temperature of the area approximately around the center of the heat roller 501 in the width direction. The left thermistor 520-2 and the right thermistor 520-3 measure the surface temperature of the area on the left end and the area on the right end of the heat roller 501.

The widths of the heat roller 501 and the pressure roller 511 are longer than that of the sheet that can be used by the image forming apparatus 100. For example, in a case in which the image can be formed on the sheet with an A3 size, the widths of the heat roller 501 and the pressure roller 511 are longer than that of A3. The center of each sheet in the width direction used in the image formation passes through approximately the center of the heat roller 501 and the pressure roller 511 regardless of the size of the width of the sheet. Thus, if the image formation is executed on a sheet having a short width, the sheet does not pass through the areas on both ends of the heat roller 501. As a result, the temperature at the areas on both ends of the heat roller 501 maintains a higher temperature without being reduced compared with the temperature at the area around the center part. In that state, if the sheet with a wider width is used in next image formation, the offset occurs so that the temperature at the areas on both ends is higher than the center, causing uneven fixing.

Figure 5:
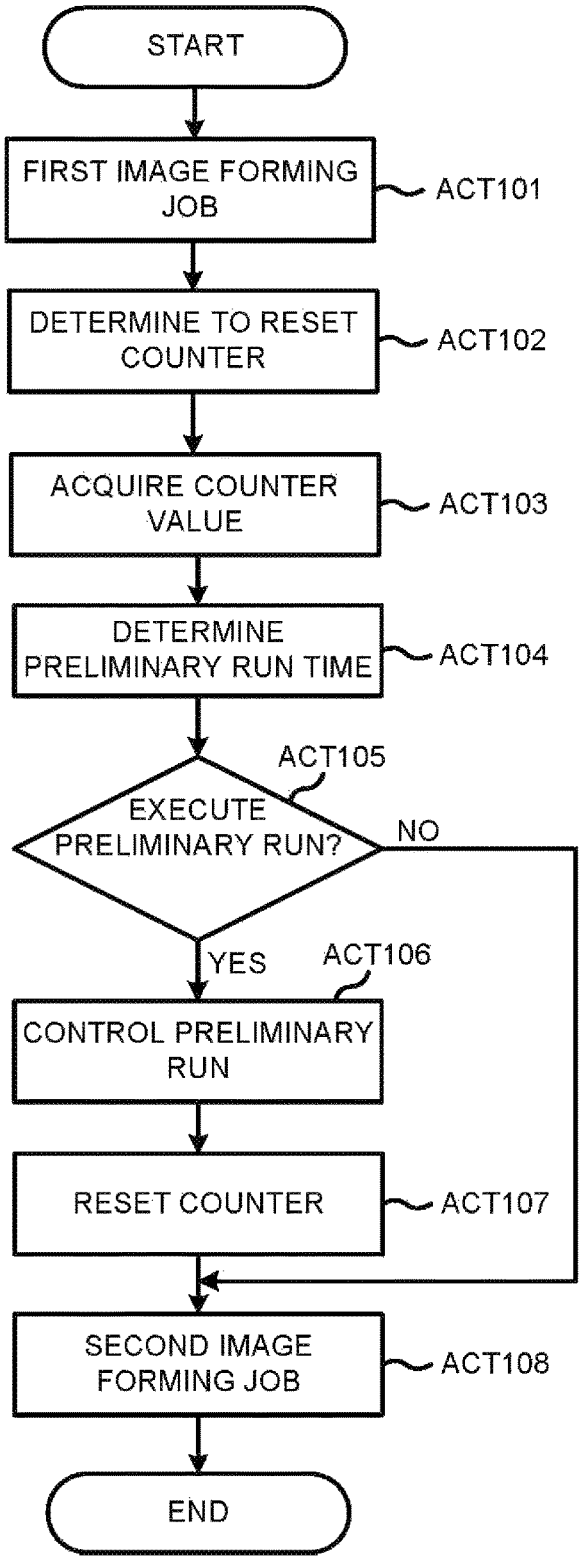
FIG. 5 is a flowchart illustrating an example sequence of operations of a controller.

FIG. 5 is a flowchart illustrating an example sequence of operations of the controller 70. First, the fixing controller 71 executes the first image forming job (ACT 101). The counter controller 73 determines whether to reset the value of the counter 72 (ACT 102). The fixing controller 71 acquires the current value (hereinafter, referred to as a "counter value") of the counter 72 (ACT 103). The fixing controller 71 determines time (hereinafter, referred to as "preliminary run time") during which the preliminary run is executed (ACT 104). The fixing controller 71, for example, may determine the preliminary run time based on the counter value, the content of the first image forming job, and the content of the second image forming job. The fixing controller 71 may determine that the preliminary run is not executed in a case in which the determined preliminary run time is 0 seconds.

If it is determined that the preliminary run is executed (Yes in ACT 105), the fixing controller 71 controls the execution of the preliminary run (ACT 106). At this time, the fixing controller 71 controls the preliminary run based on the parameters stored in the parameter storage section 61. The counter controller 73 resets the counter according to a result of the determination in ACT 102 (ACT 107). If it is determined in ACT 102 that the counter is not reset, the counter controller 73 continues the counter. In other words, in this case, the counter controller 73 does not reset the counter.

After the processing in ACT 107, or in a case in which the preliminary run is not executed (No in ACT 105), the fixing controller 71 executes the second image forming job (ACT 108).

FIGS. 6-10 are examples of the parameter table. Hereinafter, the parameter table in each diagram is described.

Furthermore, the first image forming job and the second image forming job may be respectively referred to as the first job and the second job.

In FIG. 6, the preliminary run parameters correspond to a combination of the width and the thickness of the sheet in the first image forming job and the second image forming job. In FIG. 6, information indicating whether or not the preliminary run is executed is indicated as the preliminary run control. In FIG. 6, information indicating whether to reset the value of the counter 72 is also indicated with the preliminary run parameters.

The thickness of the sheet, for example, may be defined according to the weight per unit area of the sheet. For example, it may be determined that a thin paper is 50~59 g/m$^2$, a regular paper is 60~99 g/m$^2$, and a thick paper is 100~210 g/m$^2$. The width of the sheet (paper width size) may be determined as follows. For example, it may be determined that a large width is 217 mm or more, a medium width is equal to or greater than 151 mm and smaller than 217 mm, and a small width is smaller than 151 mm.

In the example shown in FIG. 6, in a case in which the width of the sheet in the first image forming job is longer than that of the sheet in the second image forming job, the low temperature processing is not executed.

In the example shown in FIG. 6, in a case in which the widths of the sheets are different between the first image forming job and the second image forming job, the counter is reset between the first image forming job and the second image forming job.

In the example shown in FIG. 6, the low temperature processing is executed only in a condition in which the offset is likely to occur. For example, in a case in which the width of the sheet in the first image forming job is large, even if the width of the sheet in the second image forming job is large, medium or small, the offset is not likely to occur. Thus, in a case in which the width of the sheet in the first image forming job is large, the low temperature processing is not executed. On the other hand, in a case in which the width of the sheet in the first image forming job is small, if the width of the sheet in the second image forming job is large or medium, the offset is likely to occur. Thus, in such a case, the low temperature processing is executed.

In FIG. 7, the preliminary run parameters correspond to the thickness of the sheet in the first image forming job and the second image forming job. In FIG. 7, as the preliminary run parameter, a counter threshold value and information indicating preliminary run time are shown. The counter threshold value indicates a value of the counter 72 in which the preliminary run is executed. In a case in which the counter value at the time the second image forming job is started exceeds the counter threshold value, the preliminary run is executed. In other words, at the time of determining the preliminary run time in ACT 104, the fixing controller 71 determines whether or not the counter value exceeds the value of the counter threshold value. If the counter value exceeds the counter threshold value, the fixing controller 71 determines the preliminary run time as indicated in FIG. 7. On the other hand, if the counter value does not exceed the counter threshold value, the fixing controller 71 determines the preliminary run time as 0 seconds. A reference number of the counter threshold value may be, for example, 15, 25 or other number of sheets. The preliminary run time may be defined as follows, for example. It may be defined that long time is a period of 40 seconds, medium time is a period of 30 seconds, and short time is a period of 20 seconds. In the present embodiment, a necessary threshold value is determined at the time of each media condition in FIG. 7 by assuming a reference case in which the first job is executed with a regular paper and the second job is executed with the regular paper.

In the example shown in FIG. 7, if the thickness of the sheet in the second image forming job is equal to or greater than a predetermined thickness, compared with the thickness of the sheet being smaller than the predetermined thickness, execution time of the low temperature processing is short.

In the example shown in FIG. 7, for a condition in which more serious offset is likely to occur, the low temperature processing is executed over a longer time. For example, in a case in which the sheet in the first job is a thin paper, compared with a case in which the sheet in the first job is a thick paper, more serious offset is likely to occur. For example, in a case in which the sheet in the second job is the thin paper, compared with a case in which the sheet in the second job is the thick paper, more serious offset is likely to occur. In such cases, compared with other cases, the execution time of the preliminary run is defined to be longer time.

In FIG. 8, the preliminary run parameters correspond to a combination of the width and the thickness of the sheet in the first image forming job and the second image forming job. In FIG. 8, as the preliminary run parameters, a counter threshold value and information indicating the preliminary runtime are shown. For example, in a case in which the contents of the first image forming job and the second image forming job are determined as [thin paper, large] and [thin paper, small], respectively, the counter threshold value and the preliminary run time are set as 25 and 40 seconds, respectively. For example, in a case in which the contents of the first image forming job and the second image forming job respectively are determined as [regular paper, medium] and [thin paper, small], the counter threshold value and the preliminary run time are set as 100 and 30 seconds, respectively.

In FIG. 9, the preliminary run parameters correspond to the combination of surface material and the width of the sheet in the first image forming job and the second image forming job. The surface material indicates the material of a surface (front surface) on which the image formation is executed. As an example of the surface material, there is material that is not specially processed (hereinafter, referred to as a "regular paper"), and material on which special coating is executed (hereinafter, referred to as a "coated paper").

In FIG. 9, the preliminary run parameters include information indicating whether or not the preliminary run is executed. In FIG. 9, together with the preliminary run parameters, information indicating whether to reset the value of the counter 72 is also defined.

In the example shown in FIG. 9, in a case in which the sheet in the second image forming job is the coated paper, compared with a case in which the sheet is the regular paper, the execution time of the low temperature processing is longer.

In FIG. 10, the preliminary run parameters correspond to the surface material of the sheet in the first image forming job and the second image forming job. In FIG. 10, as the preliminary run parameters, a counter threshold value and information indicating the preliminary run time are shown.

According to at least one embodiment described above, the low temperature processing is dynamically controlled by the fixing controller. In particular, even if the low temperature processing is not often executed between the first image forming job and the second image forming job, the offset can be reduced. In other words, according to the contents of the first image forming job and the second image forming job, only in a condition in which the offset is likely to occur, the low temperature processing is executed. Thus, it is possible to suppress reduction in the efficiency of the operation of the image forming apparatus.

Furthermore, the execution time of the low temperature processing is dynamically controlled. For example, in a condition in which more serious offset is likely to occur, the low temperature processing is executed over a longer time. On the other hand, in a condition in which the offset is likely to be not as serious, the low temperature processing is executed in a shorter time. Through such control, the offset can be reduced more properly, and it is possible to suppress reduction in the efficiency of the operation of the image forming apparatus.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a fixing section configured to fix a toner image formed on a sheet; and a processor programmed to determine an execution time of a preliminary rotation of the fixing section and control the preliminary rotation of the fixing section for the determined execution time after execution of a first image forming job for performing image formation on a first sheet type having a first sheet width and before execution of a second image forming job for performing image formation on a second sheet type having a second sheet width longer than the first sheet width, the execution time being determined based on conditions including:

a thickness of the first sheet type used in the first image forming job and a thickness of the second sheet type used in the second image forming job, and a number of sheets of the first sheet type used in execution of the first image forming job.

2. The image forming apparatus according to claim 1, further comprising:

a storage device that stores:

different possible combinations of the thicknesses of the first sheet type and the second sheet type, and execution times for the preliminary rotation, each in correspondence with the number of sheets used in execution of the first image forming job and the different possible combinations of thicknesses.

3. The image forming apparatus according to claim 2, further comprising:

a counter configured to count a number of sheets on which an image formation job has been executed, wherein if the number counted by the counter is greater than or equal to the number of sheets stored in correspondence with the combination of thicknesses of the first sheet type and the second sheet type, the processor determines the execution time of the preliminary rotation as the corresponding stored execution time.

4. The image forming apparatus according to claim 3, wherein the processor is further programmed to reset the counter after controlling the preliminary rotation of the fixing section for the determined execution time.

5. A method of controlling a fixing section for fixing a toner image on a sheet, the method comprising:

executing a first image forming job for performing image formation on a first sheet type having a first sheet width;

determining a thickness of the first sheet type used in the first image forming job and a thickness of a second sheet type to be used in a second image forming job, the second sheet type having a second sheet width longer than the first sheet width;

determining a number of sheets of the first sheet type used in executing the first image forming job; and controlling an execution time of a preliminary rotation of the fixing section after execution of the first image forming job and before execution of the second image forming job that performs image formation on a second sheet type having a second sheet width longer than the first sheet width, the execution time being determined based on the based on conditions including:

a thickness of the first sheet type used in the first image forming job and a thickness of the second sheet type used in the second image forming job, and a number of sheets of the first sheet type used in execution of the first image forming job.

6. The method according to claim 5, further comprising:

storing different possible combinations of the thicknesses of the first sheet type and the second sheet type; and storing execution times for the preliminary rotation, each in correspondence with the number of sheets used in execution of the first image forming job and the different possible combinations of thicknesses.

7. The method according to claim 6, further comprising:

counting, on a counter, a number of sheets on which the first image formation job has been executed, wherein if the number counted by the counter is greater than or equal to the number of sheets stored in correspondence with the combination of thicknesses of the first sheet type and the second sheet type, the execution time of the preliminary rotation is determined to be the corresponding stored execution time.

8. The method according to claim 7, further comprising:

resetting the counter after controlling the preliminary rotation of the fixing section for the determined execution time.

* * * * *